US008021250B2

(12) United States Patent
Schmidt

(10) Patent No.: US 8,021,250 B2
(45) **Date of Patent: *Sep. 20, 2011**

(54) LACROSSE HEAD HAVING A BALL STOP

(75) Inventor: Joshua G. Schmidt, Royal Oak, MI (US)

(73) Assignee: Warrior Sports, Inc., Warren, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/016,493

(22) Filed: Jan. 28, 2011

(65) Prior Publication Data

US 2011/0136600 A1 Jun. 9, 2011

Related U.S. Application Data

(63) Continuation of application No. 12/359,802, filed on Jan. 26, 2009, now Pat. No. 7,905,801.

(60) Provisional application No. 61/056,865, filed on May 29, 2008.

(51) Int. Cl.
*A63B 59/02* (2006.01)
*A63B 65/12* (2006.01)

(52) U.S. Cl. ..... 473/513; D21/724

(58) Field of Classification Search ..... 473/505, 473/512, 513; D21/724
See application file for complete search history.

(56) References Cited

U.S. PATENT DOCUMENTS

| | | | | |
|---|---|---|---|---|
| 2,142,527 | A * | 1/1939 | Pool | 473/513 |
| 2,596,894 | A | 5/1952 | Frisch | |
| 4,037,841 | A | 7/1977 | Lewis, Jr. | |
| D248,679 | S | 7/1978 | Rule | |
| 4,270,756 | A | 6/1981 | Ahlenfeld et al. | |
| 4,657,260 | A * | 4/1987 | Brine, Jr. | 473/513 |
| 4,940,243 | A * | 7/1990 | Tucker et al. | 473/513 |
| 6,561,932 | B2 | 5/2003 | Morrow et al. | |
| D496,083 | S | 9/2004 | Kohler | |
| 7,344,460 | B2 | 3/2008 | Gait | |
| 7,905,801 | B2 * | 3/2011 | Schmidt | 473/513 |
| 2003/0195064 | A1 | 10/2003 | Morrow et al. | |
| 2004/0053713 | A1 | 3/2004 | Morrow et al. | |
| 2005/0043123 | A1 | 2/2005 | Harvey | |
| 2005/0064963 | A1 * | 3/2005 | Filice et al. | 473/513 |
| 2008/0268988 | A1 * | 10/2008 | Lamson et al. | 473/513 |
| 2009/0298623 | A1 | 12/2009 | Schmidt | |

OTHER PUBLICATIONS

Webpage download,NCAA Lacrosse Rules,2010,www.ncaapublications.com/productdownloads/LC10.pdf, 1 page.*

* cited by examiner

*Primary Examiner* — Gene Kim
*Assistant Examiner* — M Chambers
(74) *Attorney, Agent, or Firm* — Warner Norcross & Judd LLP

(57) ABSTRACT

A lacrosse head includes a ball stop having a bottom and side regions that transition at transition regions to head sidewalls, which are joined with a scoop of the head. The ball stop can include a longitudinal axis that extends toward the scoop. The transition regions can be located on a horizontal axis generally perpendicular to the longitudinal axis. At a distance less than or equal to 1.25 inches from the bottom along the longitudinal axis, opposing side regions and/or sidewalls are separated by a minimum width of 3 inches from the bottom. This construction provides a generally v-shaped ball stop that complies with proposed 2010 NCAA Lacrosse Rules regarding the dimensional requirements for a lacrosse head, while providing improved ball retention within the lacrosse head.

25 Claims, 10 Drawing Sheets

LACROSSE HEAD HAVING A BALL STOP

BACKGROUND OF THE INVENTION

The present invention generally relates to a lacrosse head for attachment to a lacrosse handle, and more particularly to a lacrosse head including generally v-shaped or triangular shaped ball stop.

Conventional lacrosse heads are constructed of an open frame having a ball stop joined with the base, a pair of sidewalls that diverge from the ball stop, and a scoop that connects the sidewalls, opposite the ball stop. The frame has string holes to secure a lacrosse net around the back side of the frame, leaving the opposing side of the frame open for catching or shooting a lacrosse ball. The lacrosse frame is attached to a handle by a throat that projects rearwardly from the base, with a socket formed in the throat for attachment to a handle.

To maximize ball retention in the lacrosse head, many head designs incorporate sidewalls that are narrowly spaced from one another. These sidewalls are joined at the ball stop near the throat of the head. While ball stops of older heads were formed as flat extensions connecting opposing sidewalls, such as that shown in U.S. Pat. No. 3,910,578 to Brine, most newer ball stops are usually formed by a continuous curve of a semi-circular shape that generally corresponds to the diameter and curvature of a standard lacrosse ball. Such a design, which is shown in U.S. Reissue 38,216 to Morrow, allows the ball to nestle against the ball stop during game play, both maximizing ball retention and shot accuracy.

Other designs, such as that shown in U.S. Pat. No. 4,270,756 to Ahlenfield are hybrids of the aforementioned designs, and generally include a frame with a flat ball stop that connects opposing sidewalls. A cushion including string holes is strung into the frame, adjacent the ball stop. The cushion, however, is curved to accept a lacrosse ball therein. While this construction is satisfactory, it sets the ball relatively high in the head, and generally requires that sidewalls be separated a substantial distance to accommodate the cushion and the ball. Moreover, the cushion takes a substantial amount of abuse due to repeated contact with a lacrosse ball, and can break down over time with such abuse.

In 2007, the National Collegiate Athletic Association ("NCAA") Men's Lacrosse Committee sought ways to address alleged safety concerns in the sport of lacrosse via the design of lacrosse heads. Many committee members believed that current lacrosse head designs did not allow the lacrosse ball to come out of net opening easily enough. As a result, players allegedly slashed and cross-checked other players' lacrosse sticks harder in an effort to dislodge the ball and create turnovers.

In response to these concerns, the NCAA Men's Lacrosse Committee proposed rule changes that would require the lacrosse heads to be configured to allow the lacrosse ball to come out of the head more easily, thereby reducing both the frequency and force of contact in the game. These rule changes are tentatively scheduled to go into effect in 2010 and be enforced in all NCAA Men's lacrosse competition.

One of the propose 2010 NCAA Men's Lacrosse Rules (referred to as the "Proposed Rules" herein), and in particular, Rule 1.17, addresses the minimum dimensional requirements between various portions of the sidewalls measured at a specific distance from the throat. Specifically, at distances of 1.25 and 3 inches, respectively, from the throat, particularly the ball stop, the minimum distance between the sidewalls must be 3 inches when measured between the front of opposing sidewalls (i.e., the ball receiving side) and 3 inches when measured between the rear surfaces of the sidewalls (i.e., the ball retaining side). At a distance of 5.0 inches from the throat, the minimum distance is 4.0 inches when measured between the front surfaces of the sidewalls (i.e., the ball receiving side) and 3.5 inches when measured between the rear surfaces of the sidewalls (i.e., the ball retaining side). Finally, the minimum distance at the widest point between the sidewalls is 6.5 inches on the front surfaces of the sidewalls, and 6.0 inches on the rear surfaces of the sidewalls.

The NCAA Men's Lacrosse Committee believes that the proposed rules will decrease ball retention during play. The proposed rules will also prohibit the use of currently legal head designs in NCAA competition. Although the proposed rules will help protect players against injury, players will continue to seek lacrosse heads which maximize ball retention while conforming to the new proposed NCAA rules. Therefore, lacrosse head designers face the challenge of constructing a head that conforms to the proposed 2010 NCAA dimensional requirements while still maximizing the ball retention for the player.

SUMMARY OF THE INVENTION

The present invention provides a lacrosse head that complies with the 2010 NCAA Men's Lacrosse Rules regarding the minimum dimensional requirements, but still provides a tight ball stop area with good ball retention characteristics.

In one embodiment, the head includes a generally v-shaped or generally triangular shaped ball stop. The ball stop can include a bottom, a longitudinal axis extending toward a scoop of the head, and first and second side regions near the bottom that extend away from the longitudinal axis. The side regions can be joined with sidewalls of the head at transition regions.

In another embodiment, the transition regions can be located on a horizontal axis that is generally perpendicular to the longitudinal axis. The horizontal axis can be located a distance from the bottom of the ball stop on the longitudinal axis. That first distance can be at least one of less than 1.25 inches and equal to 1.25 inches.

In yet another embodiment, the side regions and/or sidewalls can be separated by a width that is a minimum of 3 inches when measured at a distance of 1.25 inches from the bottom of the ball stop on the longitudinal axis to be compliant with the Proposed Rules. Optionally, this measurement can be taken on the front or top side of the head.

In a further embodiment, the side regions can be curvilinear and/or linear between the bottom of the ball stop and the transition regions. Optionally, if curvilinear, the side regions can be convex, concave, or of other configurations.

In yet a further embodiment, the ball stop can be curved or angled from the front of the head to the rear of the head to provide better ball retention characteristics.

The lacrosse head of the present invention provides a simple and efficient construction that enables users to better retain lacrosse balls within the lacrosse head, more accurately pass and shoot lacrosse balls, and yet still conforms to the dimensional criteria provided for in the proposed rule changes to NCAA Men's Lacrosse in 2010.

These and other objects, advantages, and features of the invention will be more fully understood and appreciated by reference to the description of the current embodiment and the drawings.

DESCRIPTION OF THE CURRENT EMBODIMENT

Figure 1:
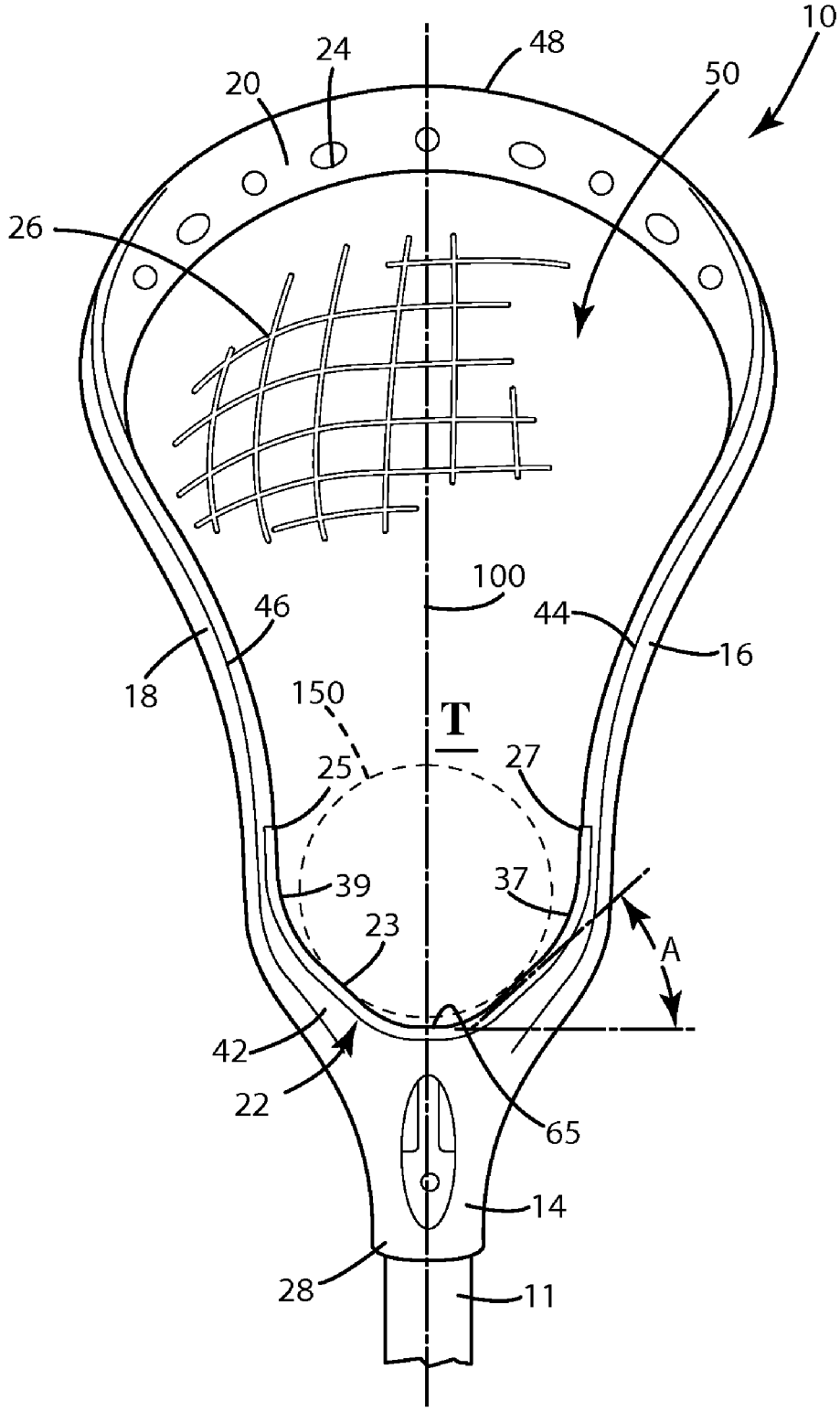
FIG. 1 is a front view of a lacrosse head in accordance with the present invention.
Figure 2:
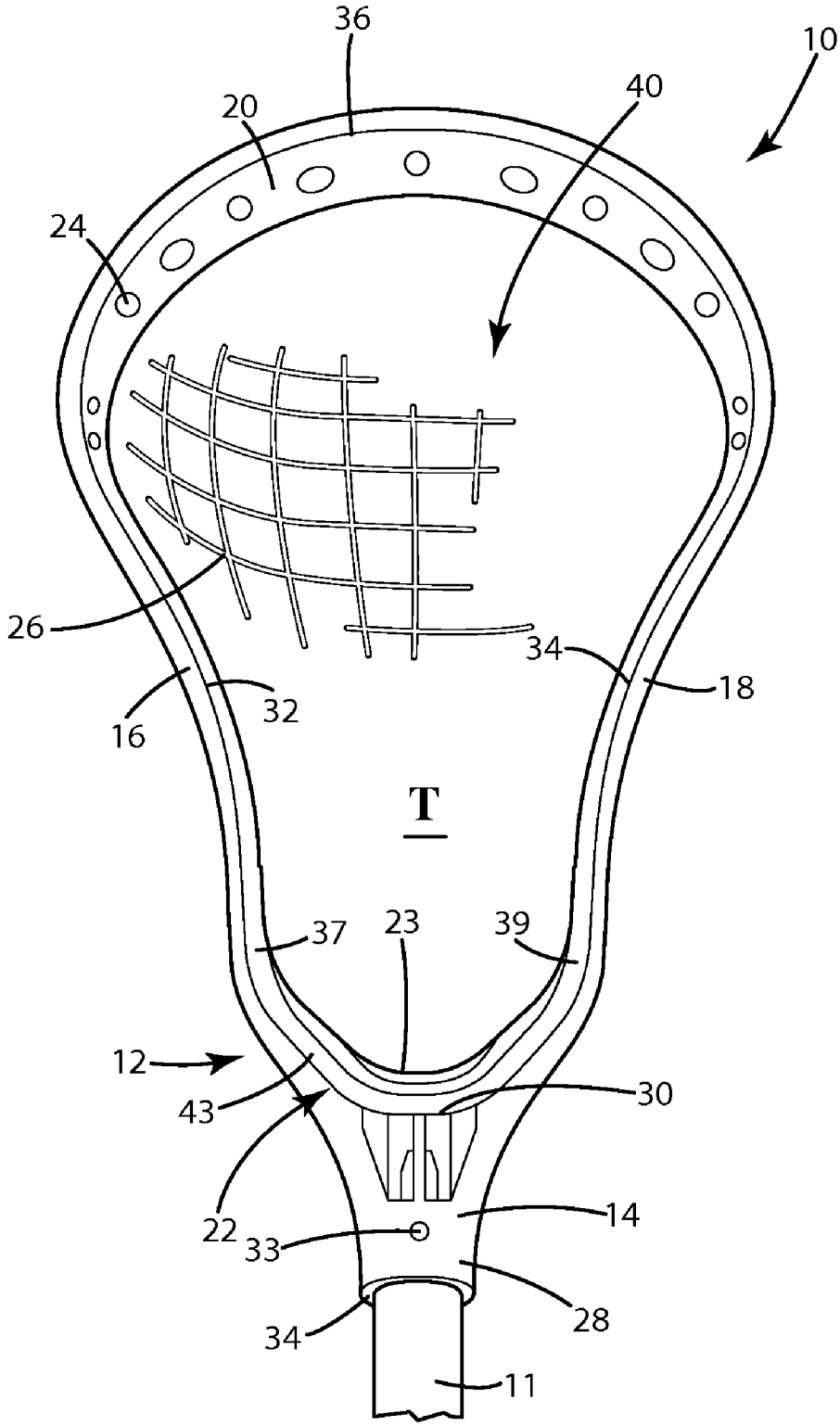
FIG. 2 is a rear view of the lacrosse head.
Figure 3:
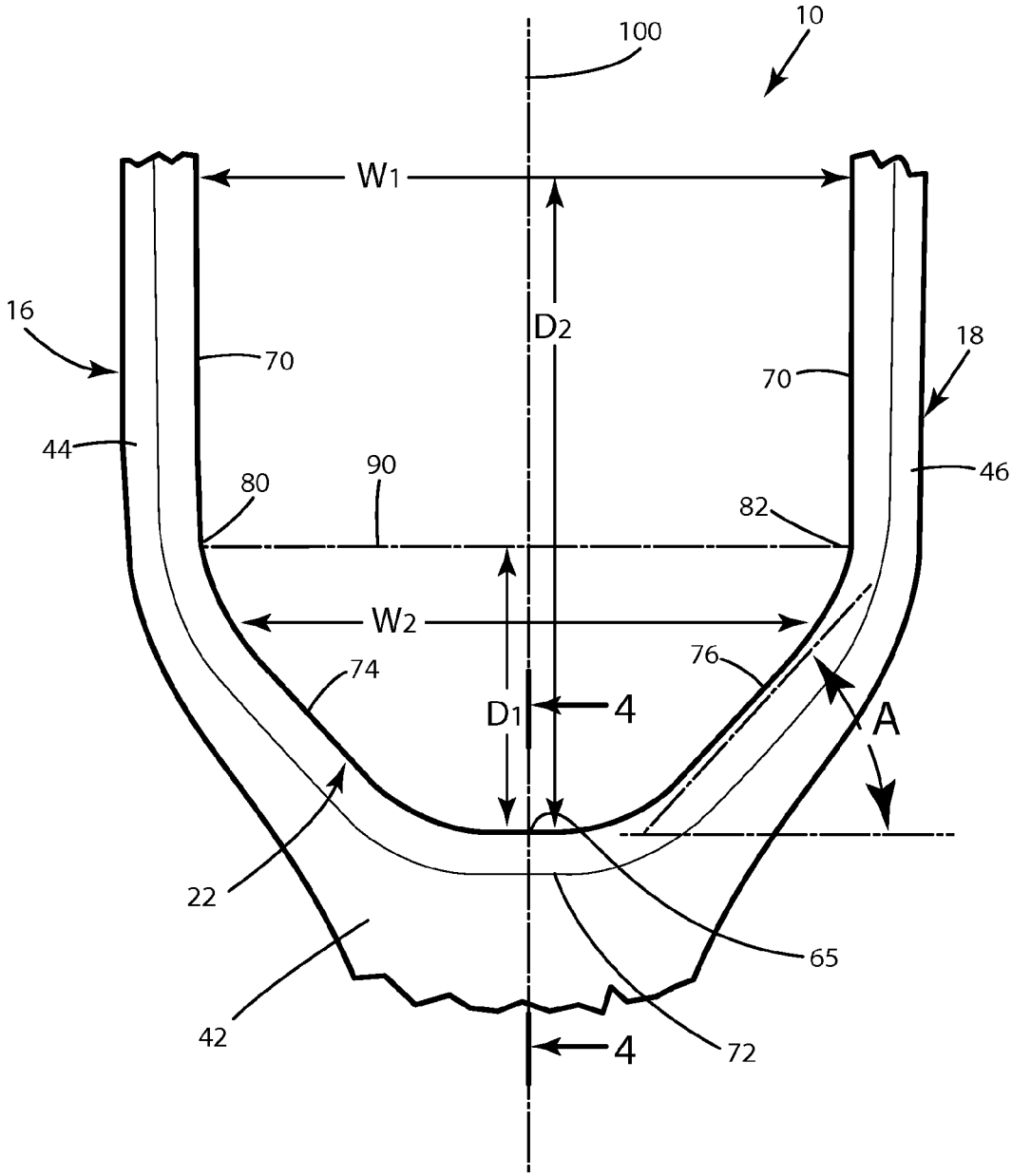
FIG. 3 is an enlarged front view of the ball stop of the lacrosse head.

A current embodiment of the lacrosse head of the present invention is shown in FIGS. 1-3 and generally designated 10. The lacrosse head 10 includes a throat 14 adapted to connect to a lacrosse handle 11, a pair of opposing sidewalls 16, 18 and a scoop 20 connecting the pair of opposing sidewalls 16, 18 opposite the throat 14. Located at the lower end of the head, adjacent the throat 14 is a base 12. The base can include a ball stop 22, to which a ball stop cushion 23 may be adhered or otherwise secured. As used herein, the term "ball stop" is intended to correspond to the term "throat" of the "crosse" as illustrated and used in the Proposed Rules. Each of the above structures will now be described in further detail.

As depicted in FIG. 1, the throat 14 can extend from the base 12, and can define a socket 34. The socket 34 can be tubular in shape and can define a cavity to receive a handle 11. Alternatively, the throat 14 can include a projection which is adapted to fit within a handle. The handle can be secured within the socket 34, optionally by a fastener 33, such as a screw, peg, or other fastening devices or materials such as adhesives. Optionally, the socket 34 can define apertures or holes (not shown) to reduce the weight of the head.

The head 10 can include a pair of sidewalls, and in particular first and second sidewalls 16 and 18. These sidewalls can be positioned on opposite sides of a longitudinal axis 100 of the head, which can generally bisect the head in opposing halves. The longitudinal axis 100 can pass directly through the middle portion 65 of the ball stop 12 as described in further detail below. One or both of the sidewalls 16, 18 can extend generally from the ball stop 22 toward the scoop 20, which is located at the opposite end of the head.

Each sidewall can include upper rims 44, 46 and lower rims 32, 34. These rims can be secured to and extend between the base 12 and the scoop 20. Alternatively, these upper and lower rims can be an extension of the base 12. In plan view, the upper rims 44, 46 can follow an outward curvilinear path near the base 12 before extending parallel to the central longitudinal axis 100 along a portion of its length, generally within the throat T of the head. The throat T can generally extend from the ball stop 22 to ½ to ⅔ the length of the ball receiving area 50 of the head. Optionally, the upper and lower rims can be of a circular, polygonal, elliptical, rectangular, or beveled cross-sections that are generally uniform or vary as these elements extend from the base 12 to the scoop 20.

Figure 5:
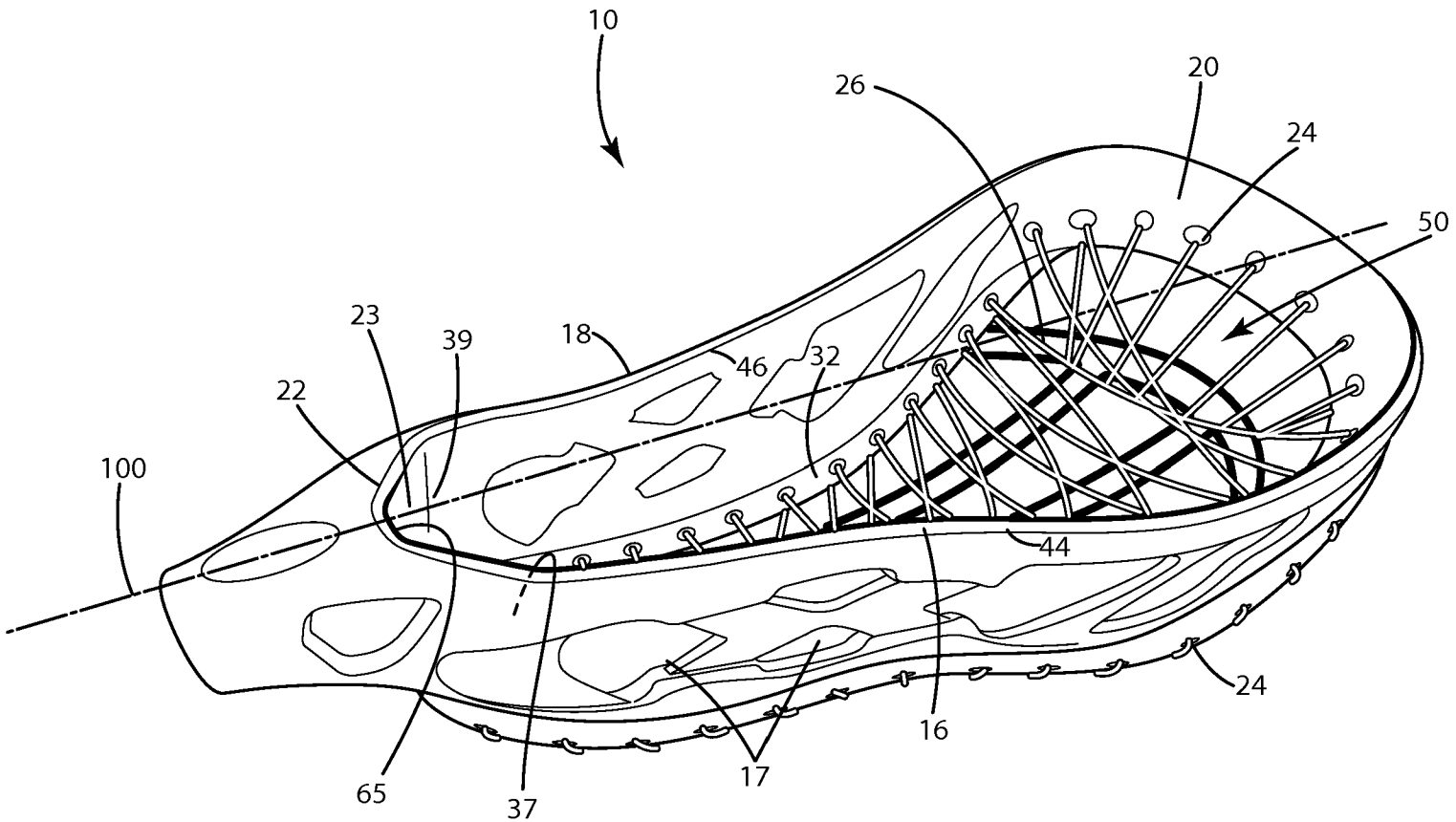
FIG. 5 is a perspective view of the lacrosse head.

As shown in FIG. 5, the sidewalls can be of an open frame construction, wherein those sidewalls define one or more non-string apertures 17 between the upper and lower rims. These apertures can be of any pre-selected shape, and can be configured for structural or aesthetic purposes as desired. In addition to the non-string holes, the sidewalls and other portions of the head can include multiple net securing structures 24 that allow attachment of netting 26 to the head 10. As shown, these structures are in the form of holes 24 defined by the various components of the head. The precise placement of these string holes can vary as desired.

As shown in FIGS. 1 and 3, the ball stop 12 can include an upper rim 42 which is joined with upper rims 44, 46 of the sidewalls 16, 18 respectively, which are further joined with the upper scoop rim 48 of the scoop 20. This bounded region can generally define a ball receiving area 50, which is where a lacrosse ball can enter or exit the head 10 when the ball 150 is caught, thrown, shot or dislodged.

As shown in FIG. 2, the ball stop can also include a lower rim 43 which is joined with the lower rims 32, 34 of the sidewalls 16, 18 respectively, which are further joined with the lower scoop rim 36 of the scoop 20. This lower bounded region can define a ball retaining area 40, which is where a lacrosse ball 150 typically is located when retained in the head 10 and more particularly in the netting 26 attached to the head 10.

Referring to FIGS. 1 and 2, the lacrosse head can be outfitted with a ball stop cushion 23, which is positioned in the ball stop 22. This cushion can include first 25 and second ends 27, the second end being distal from the first end. These ends can be joined directly with the sidewalls or portions of the ball stop 22, such as the side regions and the bottom of the ball stop as desired. The cushion can be of a uniform thickness from the first end to the second end. The cushion can be constructed from foam, or other resilient materials, and can include a cover (not shown). The cushion can be joined with the ball stop 22 with any suitable fastener, such as adhesives, strings, laces, rivets and the like.

Figure 6:
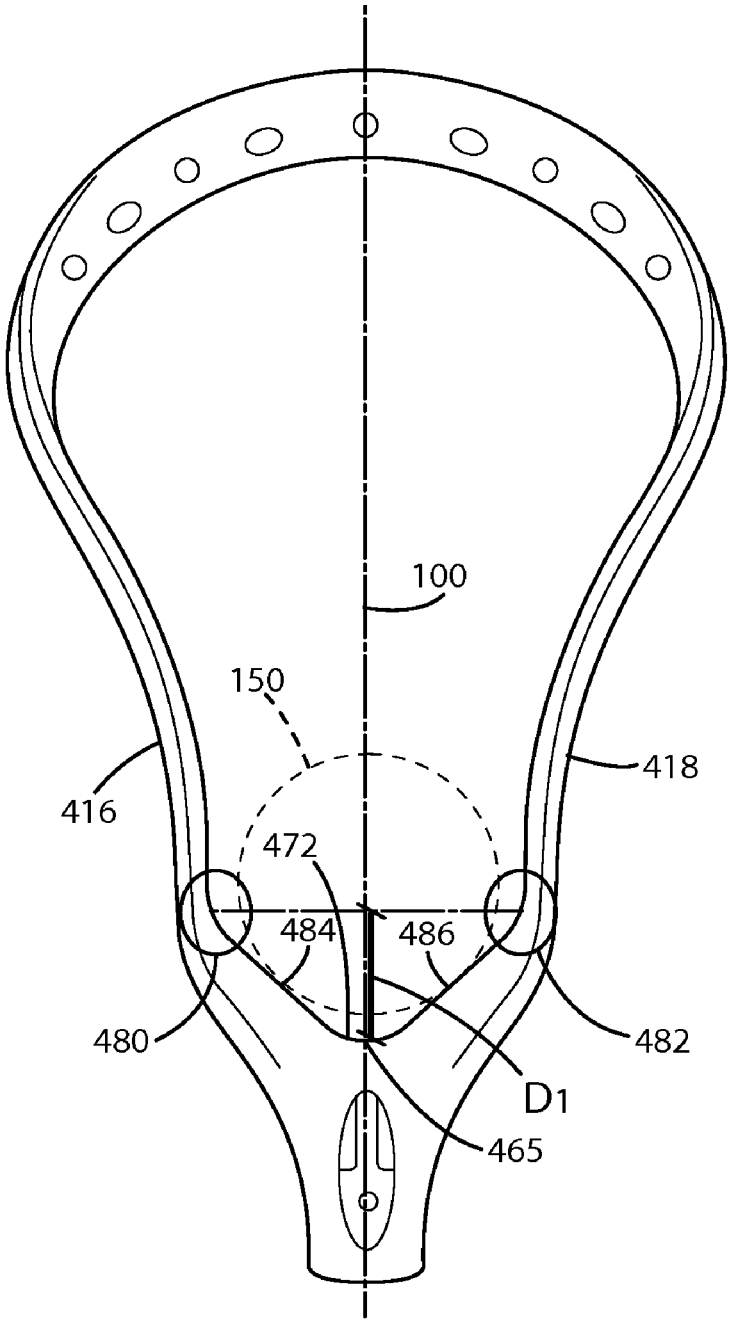
FIG. 6 is a front view of a first alternative embodiment of the lacrosse head.

Optionally, where the base and/or ball stop are constructed from a rigid plastic material, the cushion can cover at least a portion of the base and/or ball stop so that a lacrosse ball within the lacrosse head does not readily bounce off the rigid plastic material from which the base is constructed. Further optionally, the ball stop can be configured so that a lacrosse ball 150 resting in the ball stop contacts the cushion at substantially only two contact points (FIGS. 1, 6). Alternatively, where the ball stop does not include a cushion, the lacrosse ball resting in the ball stop can contact the ball stop at substantially only two contact points.

With reference to FIG. 3, the ball stop 22 of the base 12 includes several components. As shown there, the ball stop includes no cushion, but does include a bottom 72 which can be generally centrally located in the head. The bottom can include and extend outward from a middle portion 65 toward first and second side regions 74, 76 of the ball stop 22. The middle portion is also where the longitudinal axis 100 can pass through the ball stop. This middle portion can be a point on an upper ball stop rim 42 and/or lower ball stop rim, or can be a plane that intersects the longitudinal axis 100 and that is generally perpendicular to the plane within which the head lies. The bottom 72 can be of a substantially planar configuration near the middle portion, or it can be of a curvilinear configuration near the middle portion. The bottom 72 of the ball stop 22 can extend in linear or curvilinear fashion toward the side regions as desired. Optionally, the bottom 72 of the ball stop can transition to the side regions in a smooth curvilinear or curved manner, or at an angled, abrupt manner.

The first and second side regions 74, 76 can extend toward first and second transition regions 80, 82 that are located on opposite sides of the longitudinal axis 100. These side regions can be of a variety of different configurations. For example, as shown in FIGS. 1 and 3, the side regions can be generally linear and flat, extending generally linearly away from the bottom of the ball stop at an angle A. This angle A can range from a lower end of about 10°, about 20°, about 30°, about 40°, about 45° and about 50° to an upper end of about 30°, about 40°, about 45°, about 50°, about 60°, about 70°, and about 80°. Other configurations of the side regions, such as those where the side regions are curvilinear, particularly concave and/or convex toward the longitudinal axis 100, will be described in the embodiments below.

The side regions 74, 76 can transition to the sidewalls 16 and 18 respectively at some location at or less than a distance of 1.25 inches from the middle portion when measured from along the longitudinal axis 100. This transition can occur at transition regions 80, 82. As shown in FIG. 1, first 37 and second 39 transition regions are of a curvilinear configuration so that the first and second side regions of the ball stop smoothly transition to the sidewalls 16 and 18. As shown in FIG. 3, the first and second transition regions 80, 82 are alternatively of an angular configuration so that the first and second side regions 74,76 of the ball stop abruptly transition to the sidewalls 16, 18.

With reference to FIG. 3, the first and second transition regions 80, 82 can be located on a horizontal axis 90 that is generally perpendicular to the longitudinal axis 100. The horizontal axis can be located at a first distance D1 from the middle portion 65 on the bottom 72 of the ball stop along the longitudinal axis 100. Optionally, the horizontal axis 90 can intersect each of the transition points 80, 82 and the reference axis 100 at a distance D1 from the middle portion 65 of the bottom 72. The distance D1 can be less than or equal to distance D2. The distance D2 can be 1.25 inches. In such a case, the transition regions 80, 82 can be located at a distance that is less than or equal to 1.25 inches from the middle portion 65 as measured along the longitudinal axis 100. These distances D1 and D2 can be measured in any manner complying with the Proposed Rules, for example, from the inner facing surface of the middle portion 65 of the bottom 72, starting at one or the other of the upper ball stop rim 42 and the lower ball stop rim 43, and extending generally parallel to the longitudinal axis 100.

Further, the first and second side regions 84 and 86 can be separated by a width W1. The first and second sidewalls can be separated by a width W2. These widths W1 and W2 can be equal or unequal, and can be a minimum of 3 inches when measured at a distance of 1.25 inches from the bottom of the ball stop, as well as when measured 3 inches from the ball stop, and in particular, the middle portion 65, on the longitudinal axis 100. These widths can be measured in any manner complying with the Proposed Rules, for example, from the inner facing surfaces of opposing side regions, opposing sidewalls, a side region that opposes a sidewall, or any other components of the head that oppose one another across the longitudinal axis 100.

With the above dimensions, the present invention provides a lacrosse head 10 that is compliant with the Proposed Rules concerning the dimensions, yet provides exceptional ball retention of the ball near the ball stop, especially when compared to a lacrosse head with a conventional semi-circular ball stop design.

The head 10 can be of an open frame, monolithic construction and formed from one or more of a variety of compounds such as nylon, urethane, polycarbonate, polyethylene, polypropylene, polyketone or polybutylene terephalate. The head 10 can be formed by first selecting its shape and configuration. Once the shape and configuration is selected, a mold having a mold cavity can be formed in the shape of the head 10 to be formed.

Figure 4A:
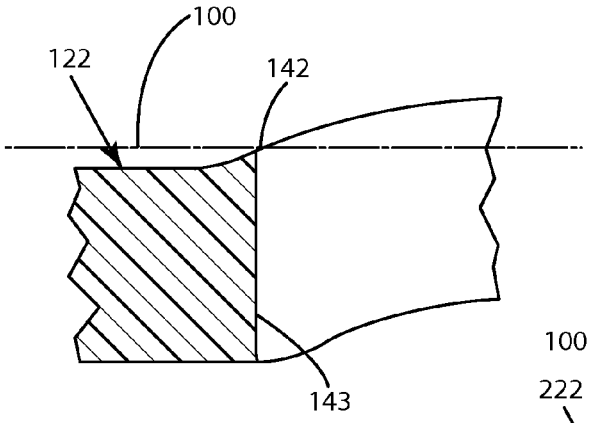
FIGS. 4A-4D are sectional views taken along line 4-4 of FIG. 3, illustrating optional alternative cross sections of the ball stop.
Figure 4B:
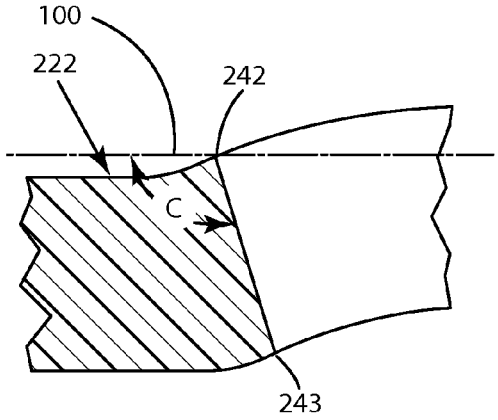
Figure 4C:
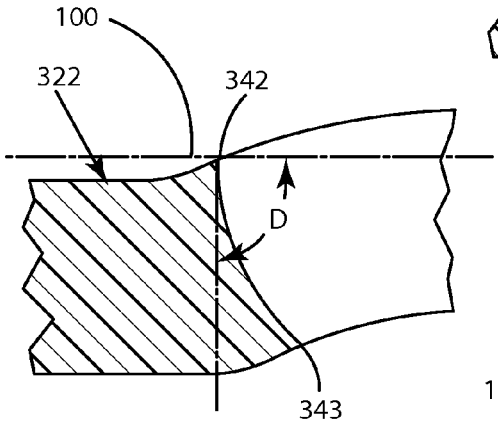
Figure 4D:
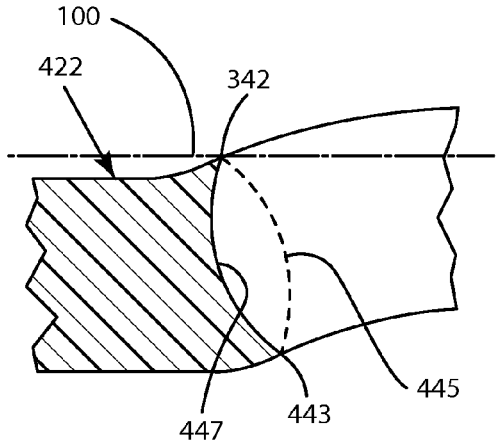

Several alternative embodiments will now be described with reference to FIGS. 4A-4D and 6-10. The embodiments of FIGS. 4A-4D illustrate optional alternative cross sections of the ball stop as it transitions from a lower ball stop rim to an upper ball stop rim. With reference to FIG. 4A, the ball stop 122 can be generally planar and perpendicular to the longitudinal axis 100 in transitioning from the upper rim 142 to the lower rim 143. As shown in FIG. 4B, the ball stop 222 can be generally planar and at some angle C relative to the longitudinal axis. This angle may be obtuse or acute depending on the desired configuration. With reference to FIG. 4C, the ball stop 322 can be generally curvilinear and disposed at some angle D relative to the longitudinal axis 100 in transitioning from the upper rim 342 to the lower rim 343. This angle may be obtuse or acute depending on the desired configuration. Referring to FIG. 4D, the ball stop 422 can be generally curvilinear, and in particular, of a concave 445 or convex 447 configuration in transitioning from the upper rim 442 to the lower rim 443.

The embodiment of FIG. 6 illustrates a slightly different configuration of a ball stop which may be dimensioned to conform to the Proposed Rules. In that configuration, the transition between the sidewalls 416, 418 (and in particular, their inner surfaces) and the ball stop side regions 484, 486 is smooth and slightly concave, as illustrated by the transition areas 480, 482, which can be at a distance D1 as described in the embodiment above. The ball stop side regions 484, 486 slope inwardly, transitioning to a concave, fully curvilinear bottom 472. In this embodiment, the bottom 472 of the ball stop near the middle portion 465 is a substantially curvilinear and transitions in a curved manner to the first and second side regions 484, 486. Further, in this embodiment as well, the side regions extend linearly at and angle away from the longitudinal axis 100.

Figure 7:
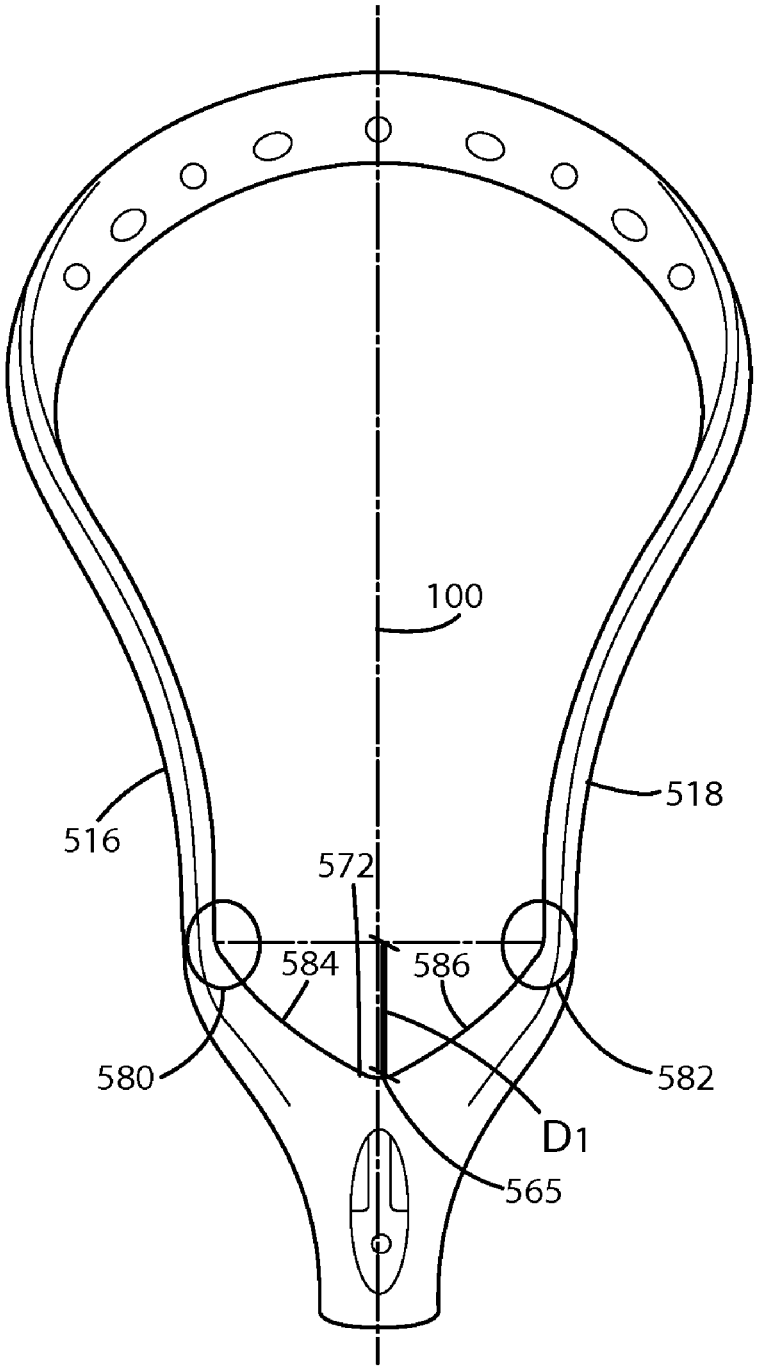
FIG. 7 is a front view of a second alternative embodiment of the lacrosse head.

The embodiment of FIG. 7 illustrates a further configuration of a ball stop which may be dimensioned to conform to the Proposed Rules. In that configuration, the ball stop side regions 584, 586 are curvilinear, and in particular, concave relative to the longitudinal axis 100, that is they bow away from the axis 100. The transition between the sidewalls 516, 518 (and in particular, their inner surfaces) and the concave side regions 584, 586 is relatively smooth, as illustrated by the transition regions 580, 582, which can be at a distance D1 as described in the embodiment above. The concave side regions 584, 586 can intersect at a point located in the middle portion 565 of the bottom 572, immediately transitioning from one curve to the other. In this embodiment, the side regions extend in a curvilinear manner away from the longitudinal axis 100.

Figure 8:
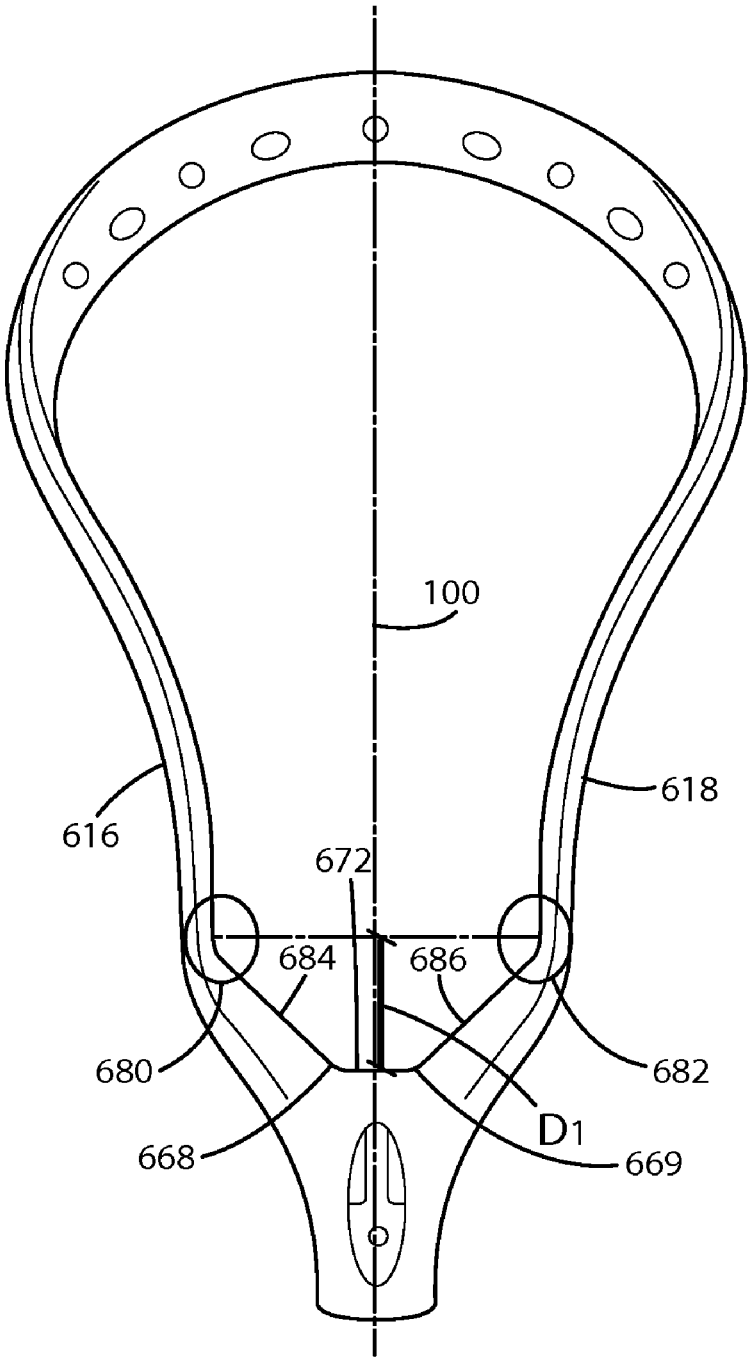
FIG. 8 is a front view of a third alternative embodiment of the lacrosse head.

The embodiment of FIG. 8 illustrates yet another configuration of a ball stop which may be dimensioned to conform to the Proposed Rules. In that configuration, the transition between the sidewalls 616, 618 (and in particular, their inner surfaces) and the ball stop side regions 684, 686 is slightly rounded, as illustrated by the transition areas 680, 682, which can be at a distance D1 as described in the embodiment above. Each ball stop side region 684, 686 is linear, sloping inwardly from the transition regions 680, 682 to secondary transition regions 668, 670 which join the ball stop bottom 672 to the side regions 684, 686.

Figure 9:
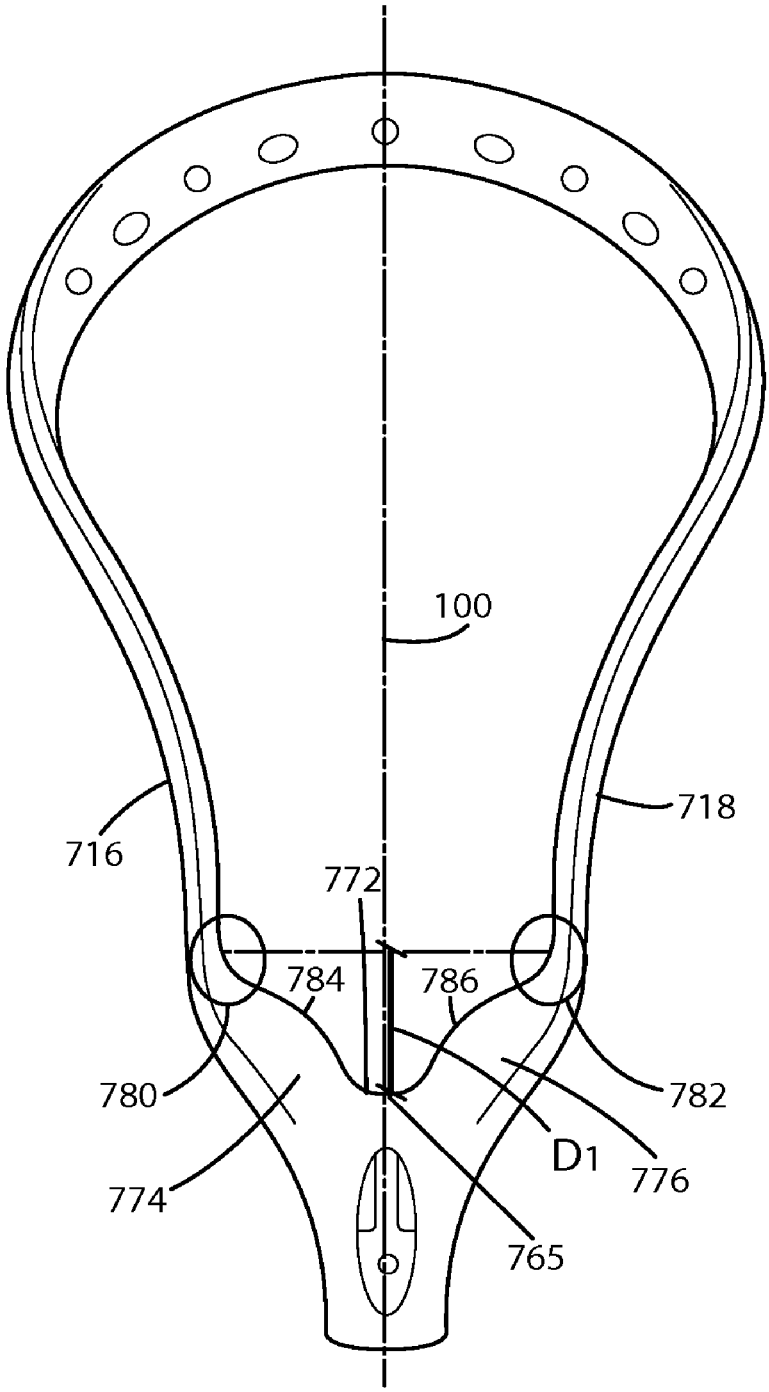
FIG. 9 is a front view of a fourth alternative embodiment of the lacrosse head.

The embodiment of FIG. 9 illustrates yet a further configuration of a ball stop which may be dimensioned to conform to the Proposed Rules. In that configuration, the ball stop side regions 784, 786 are convex, that is, they bow toward the longitudinal axis 100. The transition between the sidewalls 716, 718 (and in particular, their inner surfaces) and the ball stop side regions is smooth and concave, with the transition regions 780, 782 leading into the convex ball stop side regions 784, 786. The transition regions can be at a distance D1 as described in the embodiment above. The ball stop side regions 784, 786 can transition from a convex surface to a curvilinear bottom 772.

Figure 10:
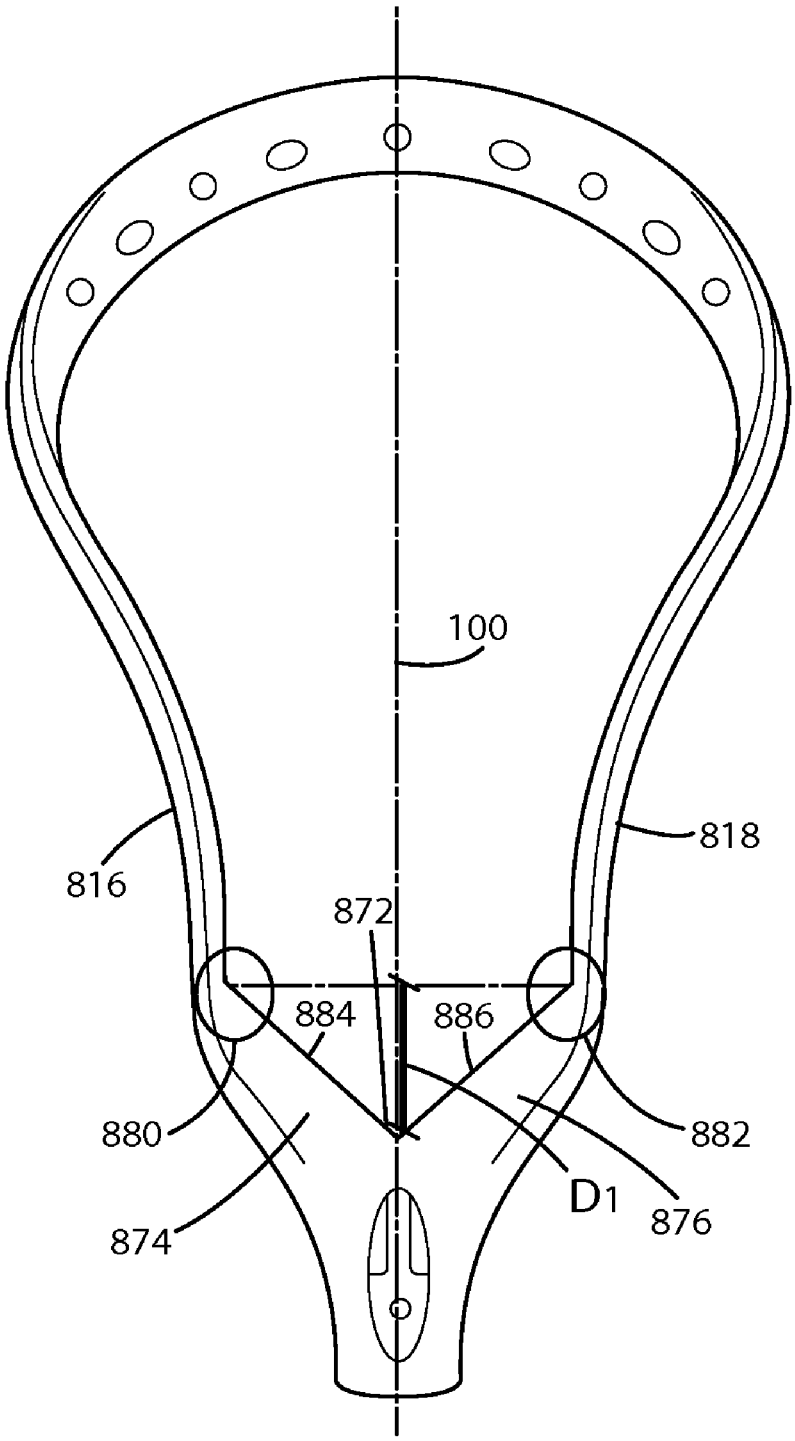
FIG. 10 is a front view of a fifth alternative embodiment of the lacrosse head.

The embodiment of FIG. 10 illustrates another further configuration of a ball stop which may be dimensioned to conform to the Proposed Rules. In that configuration, the transition between the sidewalls 816, 818 (and in particular, their inner surfaces) and the ball stop side regions 884, 886 is of an angular configuration so that the side regions of the ball stop abruptly transition to the sidewalls at transition areas 880, 882, which can be at a distance D1 as described in the embodiment above. The ball stop side regions 884, 886 can be linear, extending at an angle to the longitudinal axis 100. The side regions can meet at a point or line at the bottom 872, which can be aligned with the longitudinal axis 100.

The above description is that of the current embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The invention claimed is:

1. A lacrosse head comprising:

a throat adapted to connect to a lacrosse handle;

a base joined with the throat, the base including a ball stop;

a scoop distal from the base; and a first sidewall and a second sidewall, each extending from the base toward the scoop, wherein the throat, the base, the ball stop, the scoop, the first sidewall and the second sidewall are a single monolithic structure, wherein the ball stop includes a bottom and a longitudinal axis extending toward the scoop, wherein the ball stop includes a first side region and a second side region adjacent the bottom, the first side region and the second side region extending outwardly, away from the longitudinal axis, the first side region joined with the first sidewall at a first transition region, the second side region joined with the second sidewall at a second transition region, wherein the first side region is joined with the bottom at a first secondary transition region and the second side region is joined with the bottom at a second secondary transition region, wherein at least one of the first transition region, the second transition region, the first secondary transition region and the second secondary transition region include at least one of an abrupt transition and a curvilinear transition, wherein the first and second transition regions are located on a horizontal axis that is generally perpendicular to the longitudinal axis, wherein the horizontal axis is located a first distance from the bottom of the ball stop on the longitudinal axis, the first distance being at least one of less than 1.25 inches and equal to 1.25 inches, wherein at least one of the first and second side regions and the first and second sidewalls are separated by a first width that is a minimum of 3 inches when measured at a distance of 1.25 inches from the bottom of the ball stop on the longitudinal axis, wherein a cushion is joined with the ball stop, and adapted to engage a ball located in the ball stop, wherein a lacrosse ball resting in the ball stop contacts the cushion at substantially only two contact points.

2. The lacrosse head of claim 1 wherein the abrupt transition defines an acute angle between a plane extending from the bottom and the first side region.

3. The lacrosse head of claim 2 wherein the first sidewall forms an acute angle with a plane extending from the first side region.

4. The lacrosse head of claim 1 wherein the first and second side regions are linear as the first and second side regions extend toward the first and second transition regions.

5. A lacrosse head comprising:

a throat adapted to connect to a lacrosse handle;

a base joined with the throat, the base including a ball stop;

a scoop distal from the base; and a pair of sidewalls extending from the base and joined with one another distal from the base at the scoop, each sidewall being of an open frame construction and defining at least one string hole and at least one non-string hole, wherein the throat, the base, the ball stop, the scoop, and the pair of sidewalls are a single monolithic structure, wherein the ball stop includes a bottom including a middle portion, wherein a longitudinal axis extends longitudinally from the middle portion toward the scoop, generally bisecting the lacrosse head, wherein the ball stop includes first and second side regions, the bottom of the ball stop extending outward from the middle portion toward the first and second side regions, the first and second side regions being located on opposite sides of the longitudinal axis, the first and second side regions extending toward first and second transition regions that are located on opposite sides of the longitudinal axis, the first and second transition regions located on a horizontal axis that is generally perpendicular to the longitudinal axis, the first and second transition regions each being in a location where the ball stop transitions toward a respective one of the pair of sidewalls, wherein a first secondary transition region is defined where the bottom of the ball stop transitions toward the first side region and a second secondary transition region is defined where the bottom of the ball stop transitions toward the second side region, wherein at least one of the first transition region, the second transition region, the first secondary transition region and the second secondary transition region includes a curvilinear configuration, wherein the horizontal axis is located a first distance from the middle portion, the first distance being at least one of less than 1.25 inches and equal to 1.25 inches, wherein at least one of the first and second side regions and the pair of sidewalls are separated by a first width that is a minimum of 3 inches when measured at a distance of 1.25 inches from the middle portion on the longitudinal axis, wherein a cushion is joined with the ball stop and adapted to engage a ball located in the ball stop, wherein a lacrosse ball resting in the ball stop contacts the cushion at substantially only two contact points.

6. The lacrosse head of claim 5 wherein the cushion is of a uniform thickness from the first end to the second end.

7. The lacrosse head of claim 6 wherein the first transition region, the second transition region, the first secondary transition region and the second secondary transition region include a curvilinear configuration, wherein the first and second side regions include a curvilinear configuration, wherein a majority of the first side region has a first radius of curvature and a majority of the second side region has a second radius of curvature, wherein the first and second radii of curvature are different than a radius of curvature of the first transition region, a radius of curvature of the second transition region, a radius of curvature of the first secondary transition region and a radius of curvature of the second secondary transition region.

8. The lacrosse head of claim 7 wherein the first transition region, the second transition region, the first secondary transition region and the second secondary transition region each include a curvilinear configuration, wherein the first and second side regions include a linear configuration.

9. The lacrosse head of claim 5 wherein the bottom of the ball stop near the middle portion is substantially planar, and wherein the first and second transition regions include the curvilinear configuration so that the first and second side regions of the ball stop smoothly transition to the sidewalls.

10. The lacrosse head of claim 5 wherein the bottom of the ball stop near the middle portion is substantially planar, and wherein the first and second transition regions are of an angular configuration so that the first and second side regions of the ball stop abruptly transition to the sidewalls, and wherein the first and second secondary transition regions include the curvilinear configuration.

11. The lacrosse head of claim 5 wherein the bottom of the ball stop near the middle portion is substantially curvilinear and wherein the first and second secondary transition regions include the curvilinear configuration so that the middle portion transitions in a curved manner to the first and second side regions.

12. The lacrosse head of claim 11 wherein the first and second side regions beyond the bottom of the ball stop extend linearly at an angle away from the longitudinal axis toward the first and second transition regions.

13. The lacrosse head of claim 11 wherein the first and second side regions beyond the bottom of the ball stop extend in a curvilinear manner away from the longitudinal axis toward the first and second transition regions.

14. The lacrosse head of claim 13 wherein the first and second side regions are convex relative to the longitudinal axis.

15. The lacrosse head of claim 5 wherein the first side region and the second side region extend generally linearly away from the bottom of the ball stop at an angle with respect to a plane extending from the bottom of the ball stop, the angle being greater than 45 degrees.

16. A lacrosse head comprising:

a base including a ball stop;

a scoop distal from the base; and a first and second sidewall extending from the base and joined with the scoop, wherein the base, the ball stop, the scoop, the first sidewall, and the second sidewall are a single monolithic structure, wherein the ball stop includes a bottom including a middle portion, wherein a longitudinal axis extends longitudinally from the middle portion toward the scoop, wherein the ball stop includes first and second side regions intersecting one another at a location in the bottom so the first side region immediately transitions to the second side region, the first and second side regions joined with the first and second sidewalls at first and second transition regions, wherein the first and second transition regions are located on a horizontal axis that is generally perpendicular to the longitudinal axis, wherein each of the first transition region and the second transition region includes either a curvilinear configuration or an abrupt transition, wherein the horizontal axis is a first distance from the middle portion, the first distance being at least one of less than 1.25 inches and equal to 1.25 inches, wherein a cushion is disposed in the ball stop, wherein the ball stop is configured so that a lacrosse ball resting in the ball stop contacts the cushion at substantially only two contact points.

17. The lacrosse head of claim 16 wherein at least one of the first side region and the first side wall is a minimum of 1.5 inches from the longitudinal axis when measured at a distance of 1.25 inches from the middle portion on the longitudinal axis.

18. The lacrosse head of claim 16 comprising a second side region, wherein the first side region is a minimum of 3 inches from the second side region when measured at a distance of 1.25 inches from the middle portion on the longitudinal axis.

19. The lacrosse head of claim 16 comprising a second side wall, wherein the first side wall is a minimum of 3 inches from the second side wall when measured at a distance of 1.25 inches from the middle portion on the longitudinal axis.

20. The lacrosse head of claim 16 wherein the at least one of the first and second side regions are linear.

21. The lacrosse head of claim 19 wherein the first sidewall is a minimum distance of 3 inches from the second sidewall when measured at a distance of 3 inches from the middle portion of the longitudinal axis.

22. The lacrosse head of claim 16 wherein at least one of the first and second side regions is curvilinear.

23. The lacrosse head of claim 16 wherein at least one of the first and second side regions are convex.

24. A lacrosse head comprising:

a throat adapted to connect to a lacrosse handle;

a base joined with the throat, the base including a ball stop;

a ball stop cushion located in the ball stop;

a scoop distal from the base; and a first sidewall and a second sidewall, each extending from the base toward the scoop, wherein the throat, the base, the ball stop, the scoop, the first sidewall, and the second sidewall are a single monolithic structure, wherein the ball stop is adapted to receive a lacrosse ball when a lacrosse ball is resting in the lacrosse head, wherein a longitudinal axis extends longitudinally from the ball stop toward the scoop, wherein the ball stop includes a first side region and a second side region extending outwardly, away from the longitudinal axis, the first side region joined with the first sidewall at a first transition region, the second side region joined with the second sidewall at a second transition region, wherein the first transition region and the second transition region includes a curvilinear configuration so the first side region and the second side region each transition in a curvilinear manner to the respective first side wall and second side wall, wherein the first and second transition regions are located on a horizontal axis that is generally perpendicular to the longitudinal axis, wherein the horizontal axis is located a first distance from a bottom of the ball stop on the longitudinal axis, the first distance being at least one of less than 1.25 inches and equal to 1.25 inches, wherein at least one of the first and second side regions and the first and second sidewalls are separated by a first width that is a minimum of 3 inches when measured at a second distance of 1.25 inches from the bottom of the ball stop on the longitudinal axis, wherein the first and second side walls extend parallel to one another and parallel to the longitudinal axis substantially between the second distance of 1.25 inches from the bottom of the ball stop on the longitudinal axis and a third distance of 3.0 inches from the bottom of the ball stop on the longitudinal axis, wherein the lacrosse ball resting in the ball stop contacts the cushion at substantially only two contact points.

25. A lacrosse head comprising:

a throat adapted to connect to a lacrosse handle;

a base joined with the throat, the base including a ball stop;

a ball stop cushion located in the ball stop;

a scoop distal from the base; and a first sidewall and a second sidewall, each extending from the base toward the scoop, wherein the throat, the base, the ball stop, the scoop, the first sidewall, and the second sidewall are a single monolithic structure, wherein the ball stop includes a bottom and a longitudinal axis extending toward the scoop, wherein the ball stop includes a first side region and a second side region adjacent the bottom, the first side region and the second side region extending outwardly, away from the longitudinal axis, the first side region joined with the first sidewall at a first transition region, the second side region joined with the second sidewall at a second transition region, wherein at least one of the first side region and the second side region are a curvilinear and convex curve with an apex of the convex curve facing toward the longitudinal axis, wherein the ball stop is configured so that a lacrosse ball resting in the ball stop contacts the cushion at substantially only two contact points.

* * * * *